United States Patent [19]

Crider

[11] Patent Number: 4,836,441

[45] Date of Patent: Jun. 6, 1989

[54] MAILBOX DELIVERY INDICATOR

[76] Inventor: Curtis W. Crider, 1077 Robert St., Ormond Beach, Fla. 32074

[21] Appl. No.: 170,435

[22] Filed: Mar. 15, 1988

[51] Int. Cl.[4] ..... B65D 91/00

[52] U.S. Cl. ..... 232/35; 232/34

[58] Field of Search ..... 232/34, 17, 35

[56] References Cited

U.S. PATENT DOCUMENTS

| | | | |
|---|---|---|---|
| 2,421,603 | 6/1947 | Doppelhammer | 232/35 |
| 2,988,268 | 6/1961 | Mioduski | 232/35 |
| 3,589,329 | 6/1971 | Schuh | 232/35 X |
| 3,650,464 | 3/1972 | Lewis | 232/35 |
| 3,747,839 | 7/1973 | Morton | 232/35 |
| 3,815,811 | 6/1974 | Harmon | 232/35 |
| 4,190,193 | 2/1980 | Smith | 232/35 |

*Primary Examiner*—Robert W. Gibson, Jr.
*Attorney, Agent, or Firm*—Edward M. Livingston

[57] ABSTRACT

A mail delivery indicating device which attaches to the side of a standard rural mailbox and drops a signal flag when the front cover is opened upon mail delivery. The device is especially designed for ease of assembly, installation and operation having only three (3) separate parts, a base with support arm and flag, a metal clip for the front door and a screw for attaching the device to a mailbox. The device is simply installed by inserting the one (1) screw in the pre-drilled hole in the mailbox, sliding the clip on the front door and closing the cover upon the trip lever of the device. When the cover is opened, the trip lever is released, thereby allowing the flag to drop downward so the homeowner can see whether mail has been delivered without having to leave the house. An additional feature includes a flag portion on the end of the signal arm which consists of two (2) perpendicular flags so the device may be seen from all directions.

3 Claims, 1 Drawing Sheet

MAILBOX DELIVERY INDICATOR

BACKGROUND OF THE INVENTION

This invention relates generally to rural mailboxes and more particularly to a signal device which indicates when mail has been delivered.

In rural areas mail is normally delivered by a motor vehicle and is placed in a standard mailbox mounted at the curbside for each residence. Currently, standard mailboxes which are approved by the postal service have a red flag on one side, which at the option of the homeowner may be placed in the upright position to advise the postal deliverer there is mail to pick up. Unfortunately, no signal device is provided on such mailboxes to advise the homeowner when mail has been delivered to a mailbox or that the postman has been there to pick up mail placed in the box. The lack of such a signal device results in the homeowner having to leave the house on one or more occasions, often in inclement weather, to check the mailbox. This latter requirement that numerous visits be made to the mailbox is especially difficult for older people.

Some prior devices have attempted to resolve the lack of a mailbox delivery indicating device. For instance, U.S. Pat. No. 3,602,424 by Raulston shows a signal flag mounted on the side of a mailbox and held horizontally by an arm on the cover door which drops a signal flag when the door is open. However, Raulston's invention, as do several others, requires a horizontal piece to be added to the front cover. Further, the flag is two-dimensional which cannot be seen well from the front or back but just from the sides. U.S. Pat. No. 2,988,268 by Mioduski shows a flag indicator which falls backward and downward when the front cover is opened. This device, too, requires that a horizontal bar be added to the front cover to hold the flag. Also, Mioduski's flag indicator would interfere with the standard red flag currently on mailboxes. Another patent, U.S. Pat. No. 3,670,897 by Gagnon, shows a flag signal device which drops when the door is opened. However, this device requires an extra arm and an extension on the front cover of the mailbox. U.S. Pat. No. 4,150,780 by Mapes shows a flag which drops when the box is open by means of a trip wire. U.S. Pat. No. 3,960,317 by Clement shows a device affixed to the door of the box which goes into the upright vertical position when the front cover of the mailbox is opened. And, finally, U.S. Pat. No. 3,815,811 by Harmon shows a device consisting of a little flag and hook which pivots downward.

All the above patented devices require modification of the mailbox and, thus, extra effort to install. Some of the devices also interfere with the red flag currently on mailboxes and with the opening and closing of the door. Still others require extra holes to be made into the mailbox which can cause leaking. On the contrary, the instant device is simple in design and application. The instant device comes completely assembled and attaches to the mailbox by merely inserting one (1) screw in the predrilled hole already in the mailbox. Since it has no attachments to the front door of the mailbox other than a small clip, it does not interfere whatsoever with the opening and closing of the mailbox. Moreover, since it contains a three-dimensional flag portion, it enables the device to be seen from all directions, from the front and back as well as the sides.

SUMMARRY OF THE INVENTION

The primary object of the instant invention is to provide a device which may be attached to a mailbox and usable to indicate mail deliver.

A second object of the invention is to provide such a device which is easy and simple to install an existing mailbox.

Another object of the invention is to provide such a mailbox delivery indicating device which does not interfere with the opening and closing of the front door of a mailbox.

An even further object of the instant invention is to provide such a device which when installed does not create the possibility of water leaks into the mailbox.

Another object of the instant invention is to provide such a device which is easy to see from the house from all directions.

An additional object of the instant invention is to provide such a device which does not interfere with the standard red flag used to indicate that there is mail to pick up.

A further object of the instant invention is to provide such a device which does not obscure or cover a person's name and address on the mailbox.

The instant invention accomplishes the above and other objects by providing a device which contains a signal flag which drops when the cover is opened. The device is easy to install because it has only three (3) parts, a base with signal arm and trip lever, a screw to attach said base to a pre-drilled hole already in the standard mailbox and a small clip which just attaches to the front cover of the mailbox. Other than the clip, the device has no levers or bars which attach to the front door itself so that nothing gets tangled as with other such devices. Since the pre-drilled hole in the mailbox is utilized for its installation, no new holes are required to be drilled in the mailbox and, thus, eliminates the possibility of leaks due thereto. The device is easily seen from all directions because it contains a three-dimensional flag portion which has perpendicular flags. The device does not interfere with the standard red flag because it is designed to be placed on the opposite side of the mailbox. Finally, the device is installed very low on the side of the mailbox so that it does not cover the name and address of the resident.

Other objects, advantages and features of the invention will become more readily apparent from the following detailed description of the specific embodiments thereof when read in conjunction with the accompanying drawings.

BRIEF DESCRIPTION OF THE DRAWINGS

The drawings appended to this application are as follows.

DETAILED DESCRIPTION OF THE PREFERRED EMBODIMENT

Figure 1:
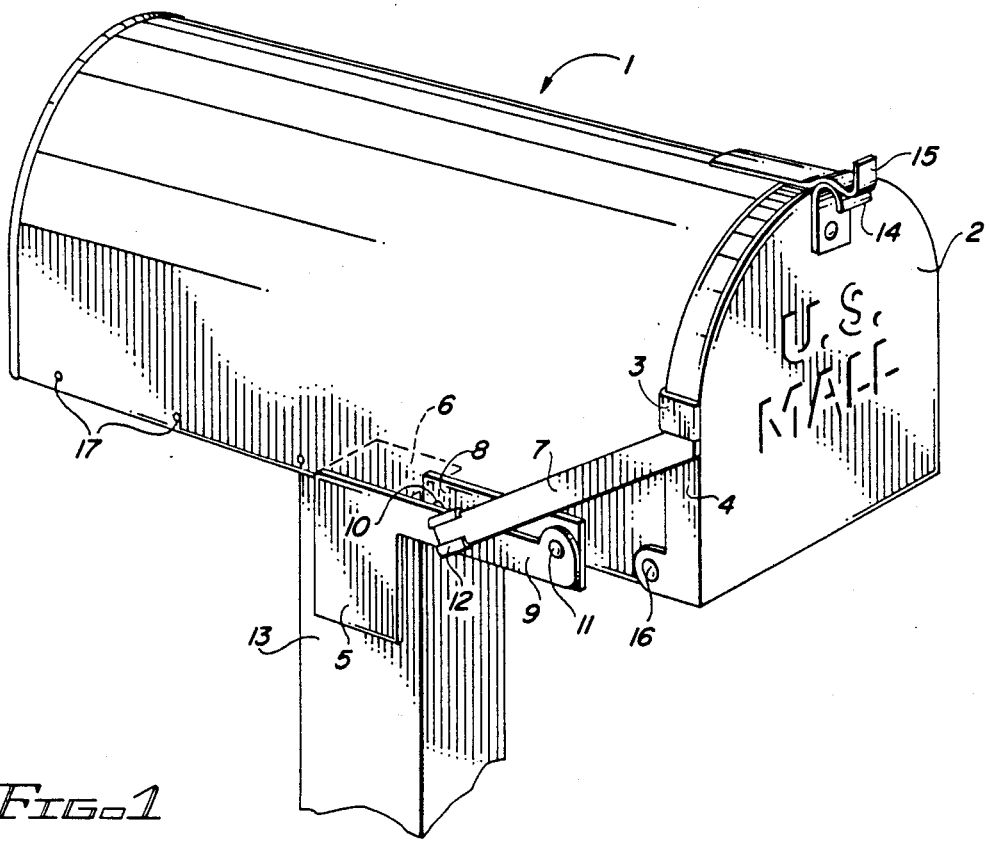
FIG. 1 is a perspective view of the device installed on a mailbox with the front door closed and the device in an unactivated state.

Referring in detail to the drawings, FIG. 1 shows a mailbox with the device in an unactivated state. In FIG. 1 a standard U.S. Postal Service approved rural mailbox 1 is shown having a rounded top and enclosed sides and back, a front door 2 with pivot hinge 16, a handle 14 for opening and a leaf spring latch member 15 for securing the door 2 when closed. In addition, the mailbox 1 has several pre-drilled holes 17 along the lower sides. The mailbox 1 is supported by a support post 13. Finally, the standard mailbox 1 also has a red flag on the opposite side not shown in the drawings to indicate there is mail to pick up.

The device, itself, consists of a base 8 having a support arm 9 attached to it by a pivot bolt with acorn nut 11. At the opposite end of the support arm 9 of the device is the side of the flag portion 5. The device also has a trip lever 7 attached to the arm 9 by insertion into a sleeve 12 on said arm 9. This trip lever 7 extends at an approximately 45 degree angle from the arm 9 to the side 4 of the front door 2 where it is held by a clip 3. The clip 3 is a V-shaped piece with two leaf spring members which attaches to the side 4 of the front door 2. When the front door 2 is closed, the trip lever 7 of the device is placed under the clip 3 to place the device in a ready state.

Figure 2:
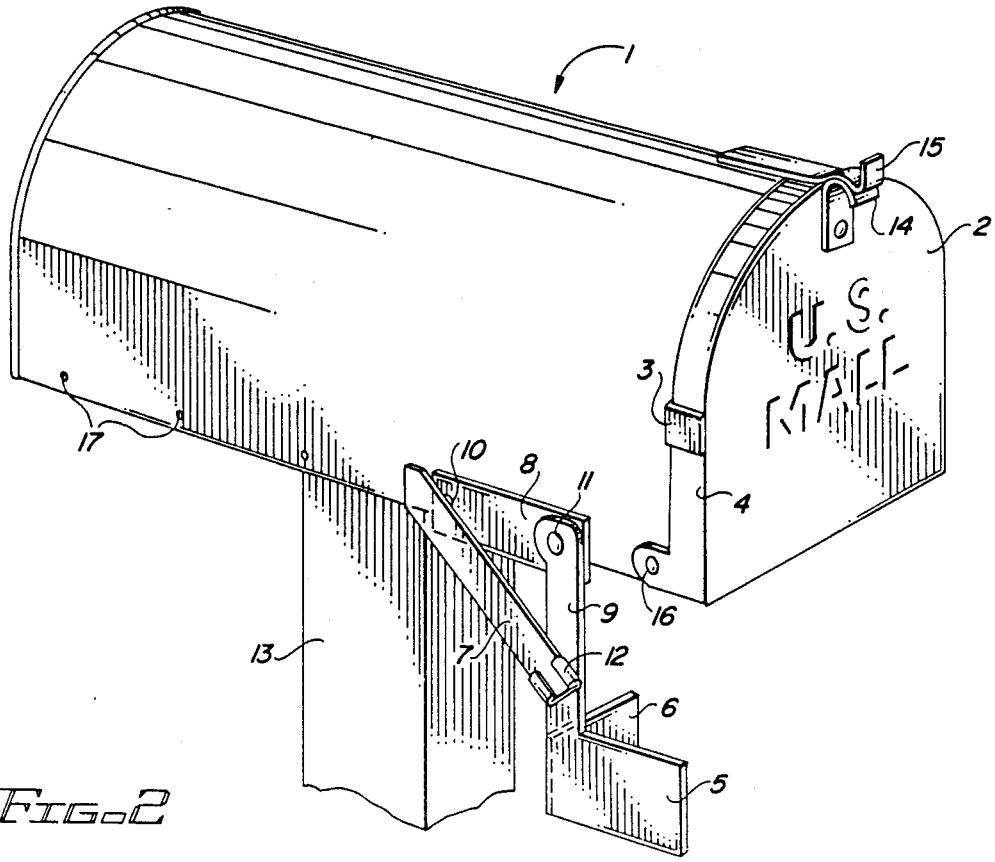
FIG. 2 is a perspective view showing the mailbox after the cover door has been opened and the device is in the lowered, activated state.

The instant invention is shown in the activated state in FIG. 2 after the front door 2 has been opened and mail delivered. When the device is activated, the trip lever 7 of the device is released from under the clip 3 and the weight of the arm 9 makes the arm 9 drop backward and downward to expose the entire flag portion consisting of a side flag 5 and top flag 6, attached perpendicularly to each other. FIG. 2 now shows the screw 10 which holds the device onto the side of the mailbox 1.

The assembly and installation of the device is quick and easy requiring only a screwdriver, contrary to prior devices designed to indicate mail delivery. The device comes completely assembled except for the clip 3 which attaches to the front door 2 and the screw 10 which secures the device to the side of the mailbox 1, opposite the standard red flag. Once installed, the lever 7 is placed in the clip 3. When the mailbox 1 is closed the device is fully automatic; when the postal delivery person opens the door 2, the clip 3 moves frontward releasing the trip lever 7, thereby allowing the arm 9 and flag, 5 and 6, to fall down. The flag portion, consisting of a side signal flag 5 and top signal flag 6, is designed to be seen from both sides by approaching cars or from the back from the door of the residence. Once the homeowner removes the mail from the mailbox 1, the device is easily reset by pulling the trip lever 7 upward and forward and resting it under the clip 3 so that the arm 9 and flags 5 and 6 are once again in the horizontal position.

All parts of the instant device, except the clip 3 and screw 10, can be made from polished aluminum, high grade plastic or other durable material. The other two (2) parts of the device, the clip 3 and screw 10, will likely be made of metal.

Thus, as described in detail hereinabove, it should be apparent that there has been provided a new, useful and nonobvious device designed to be easily and simply attached to a standard mailbox for advising the homeowner when mail has been delivered. In addition to being easy to assemble and install, the device offers several other advantages over other prior devices. As described, it contains no bars or attachments which would interfere with the opening and closing of the front door of the mailbox. It requires no modification to the mailbox or extra holes to be drilled that might result in leaks. The device has increased visibility because it can be provided with two (2) flags, a top and a side one, so it can be viewed from all directions. Even further, the device is positioned on the mailbox so that it does not obscure or cover any names or addresses on the side of the mailbox.

While specific embodiments of the invention have been described in detail hereinabove, it is to be understood that various modifications may be made from the specific details described hereinabove without departing from the spirit and scope of the invention as set forth in the appended claims.

Having described in detail my invention, I claim the following:

1. A mail delivery indicating device for attachment to a standard rural mailbox having a closed receptacle with a hinged front door, the device comprising:

a base mounted to the exterior bottom side of the mailbox;

an arm pivotally mounted at one end to said base, said arm having a signal portion thereon;

a trip lever attached to said arm and extending diagonally from the arm to the front door of the mailbox when the arm is in the horizontal position; and means of holding the trip lever in the front door of the mailbox to maintain the arm in the horizontal position when said door is closed.

2. The mail delivery indicating device of claim 1 wherein the means of holding the trip lever consists of a clip having leaf spring members for attachment to the side of the front door for placing the trip lever thereunder when the door is closed, said clip which releases the trip lever when the front door of the mailbox is opened.

3. The mailbox delivery indicating device of claims 1 or 2 wherein the signal portion on the arm consists of a flag portion on the rear end of the arm having two sides extending perpendicular to each other from said arm.

* * * * *